United States Patent [19]

Sollinger et al.

[11] Patent Number: 4,869,933

[45] Date of Patent: Sep. 26, 1989

[54] COATING DEVICE

[75] Inventors: Hans-Peter Sollinger; Martin Kustermann, both of Heidenheim, Fed. Rep. of Germany

[73] Assignee: J. M. Voith GmbH, Heidenheim, Fed. Rep. of Germany

[21] Appl. No.: 111,492

[22] Filed: Oct. 22, 1987

[30] Foreign Application Priority Data

Oct. 25, 1986 [DE] Fed. Rep. of Germany ..... 3636453

[51] Int. Cl.[4] ..... B05D 3/12

[52] U.S. Cl. ..... 427/356; 118/126; 118/410; 118/414

[58] Field of Search ..... 118/410, 413, 414, 119, 118/126; 427/355, 356, 358

[56] References Cited

U.S. PATENT DOCUMENTS

| | | | |
|---|---|---|---|
| 2,066,780 | 1/1937 | Holt | 118/414 X |
| 2,970,564 | 2/1961 | Warner | 118/249 |
| 3,084,663 | 4/1963 | Warner | 118/118 |
| 4,263,870 | 4/1981 | Saito et al. | 118/414 X |
| 4,375,202 | 3/1983 | Miller | 118/119 X |
| 4,405,661 | 9/1983 | Alheid | 118/413 X |
| 4,407,227 | 10/1983 | Mauranen | 118/126 X |
| 4,452,833 | 6/1984 | Holt | 118/410 X |
| 4,757,782 | 7/1988 | Pullinen | 118/414 X |

FOREIGN PATENT DOCUMENTS

| | | | |
|---|---|---|---|
| 3620374 | 2/1987 | Fed. Rep. of Germany | 118/410 |

*Primary Examiner*—Shrive Beck
*Assistant Examiner*—Alain Bashore
*Attorney, Agent, or Firm*—Lon H. Romanski

[57] ABSTRACT

At the outflow-side end of a pre-dosing device, which comprises an applicator chamber formed at the product web in the region where the latter is guided by a counter-cylinder, a rolling doctor rod, wire wrapped or provided with circumferential grooves, is provided as a pre-dosing element, whereby high excess amounts of coating compound can be applied on the product web.

17 Claims, 2 Drawing Sheets

COATING DEVICE

Field of the Invention

This invention relates generally to apparatus for coating paper and other penetrable or soakable web material and more particularly to structure for applying, as in a preliminary phase, a controlled amount of coating to such web material which amount includes an excess to be subsequently wiped off as by a doctor blade.

BACKGROUND OF THE INVENTION

The prior art has heretofore proposed the use of a pre-dosing stage and a pre-dosing device for use in coating moving paper and other web material. Generally, in such prior art arrangements, the overall coating apparatus has a coating applicator chamber which at the exit end thereof (that being the end of the coating applicator chamber where the moving paper web leaves such applicator chamber) is effectively defined by a rolling doctor rod. Such a pre-dosing or pre-applicator device is generally known from the publication "Wochenblatt Fuer Papierfabrikation", No. 17, dated 1970, at pages 777 to 782 and in particular at page 780 thereof shown in FIG. 12*a* along with related descriptive text on that page. The purpose and function of such pre-dosing device is to cause the coating material of the applicator space to be applied to the moving paper web at a rate greater than that subsequently desired and determined by a secondary or finishing doctor blade. In such prior art arrangements, the exit end of the applicator chamber is provided with an effectively transverse dosing gap of between 0.1 mm. and 0.3 mm However, it has been found that with such prior art arrangements it is difficult to achieve uniform pre-dosing of the coating application in that line-type irregularities appear in the coating application; moreover, for all practical purposes, it is impossible, with such prior art arrangements, to achieve uniform pre-dosing of the coating application when the paper web speed exceeds 800 m/min.

Accordingly, the invention as herein disclosed and described is primarily directed to the solution of the aforestated and other related and attendant problems of the prior art.

SUMMARY OF THE INVENTION

According to the invention, a pre-dosing device, for use in a coating arrangement for coating a moving web of penetrable or soakable material and having an applicator chamber disposed at a rotating cylinder guiding the web material to be coated, wherein said applicator chamber comprises an inlet side and an outlet side with an inlet-side gap formed at said inlet side and an outlet-side gap formed at said outlet side, wherein said web of material passes through said inlet-side gap and said outlet-side gap, and wherein a doctor element is situated as to operatively engage said moving web of material at a location which is after said web of material exits said outlet side of said applicator chamber, comprises a rolling doctor rod having a longitudinally extending axis, wherein said rolling doctor rod comprises circumferential grooves formed therein and about said axis, wherein the space defined by said grooves at least in part forms that outlet-side gap and wherein the cross-sectional area of said grooves is at least $0.1d^2$ or corresponds to the cross-sectional area of said grooves formed by wire threads of a wire-wound doctor roll at the outer circumference of the wire threads, wherein the diameter d of the wire is at least 1.5 mm, the wire threads or grooves being positioned side by side.

It is an object of this invention to provide a pre-dosing device whereby a uniform coating application is possible at very high pre-dosing quantities with an excess of at least five times the final coating application.

Various other general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details may be omitted from one or more views.

DETAILED DESCRIPTION OF THE PREFERRED EMBODIMENT

Figure 1:
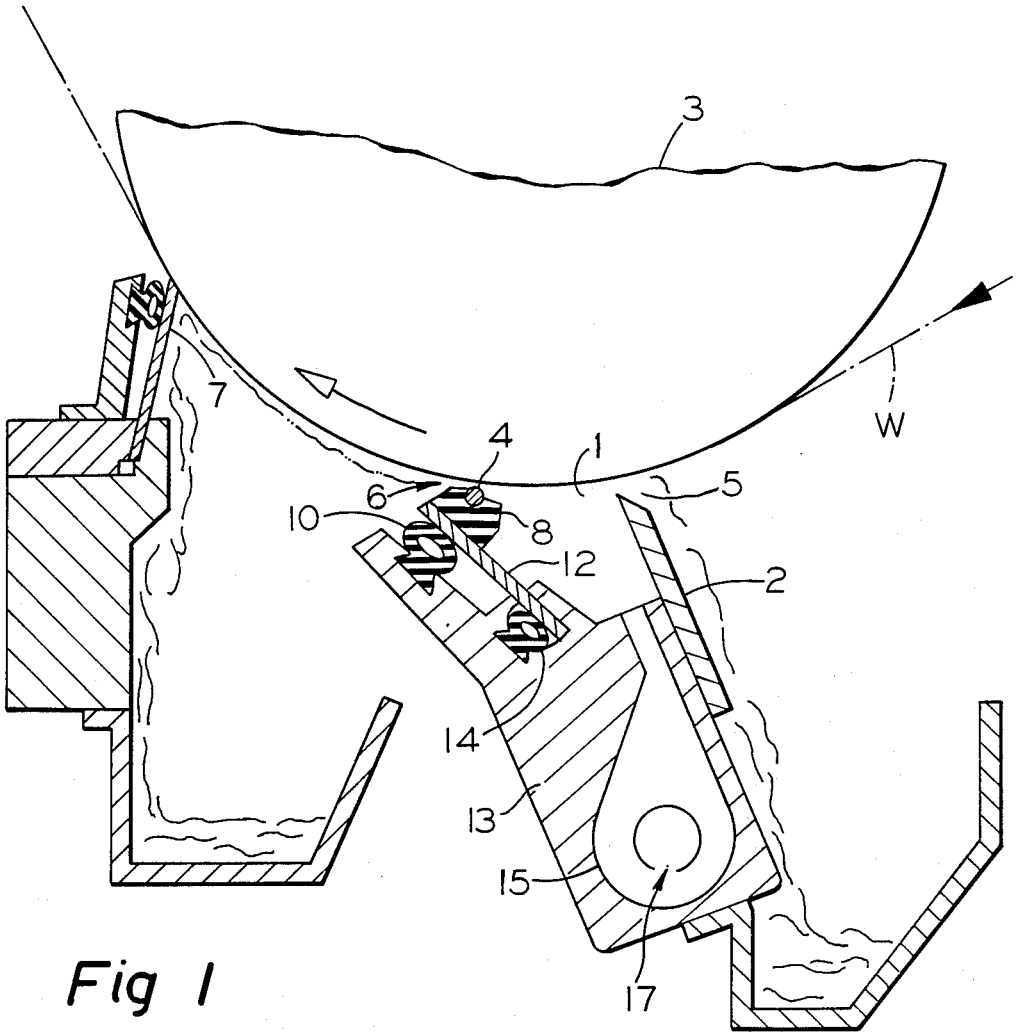
FIG. 1 is a fragmentary cross-sectional view of a coating installation or apparatus illustrating a pre-dosing device employing teachings of the invention.

Referring now in greater detail to the drawings, FIG. 1 illustrates a coating apparatus comprising an overall housing means 13 with a chamber into which a supply pipe or conduit 15 extends; preferably such chamber is of a length (perpendicular to the plane of the drawing) which is substantially equal to the width of the moving paper web, W. A plurality of openings, one of which is shown at 17, formed in the conduit 15 serve to introduce the coating material, from conduit 15, as evenly as possible into and along the length of the chamber which generally receives conduit 15. Conduit 15 receives fresh coating substance at a superatmospheric pressure from an associated source (not shown).

The coating substance flows upwardly out of the lower chamber through a generally upwardly extending passageway having, preferably, a slit-like discharge mouth so that such coating substance, as flows out of the slit-like discharge mouth, enters into an applicator space or chamber 1 which, as viewed in FIG. 1, exists generally above the overall housing means 13. Preferably, the length of the slit-like discharge mouth (in a direction perpendicular to the plane of the drawing) is such as to extend for the full width of the moving paper web, W.

The moving paper web, W, held against a rotating drum or cylinder 3, in effect defines the general upper (as viewed in FIG. 1) limits of the applicator space or chamber 1.

A throttle plate or member 2, operatively carried as by the housing means 13, is positioned as to have its upper end (as viewed in FIG. 1) juxtaposed and in spaced relationship to the paper web, W, and rotating cylinder 3 thereby defining a transversely extending gap 5.

A rolling doctor rod 4, having its axis of rotation perpendicular to the plane of the drawing, is held effectively against the moving paper web, W, as by an associated support or bed 8 which, in turn, is preferably supported as on leaf spring means 12.

As depicted in FIG. 1 the primary applicator space or chamber 1, which extends (in a direction perpendicular to the plane of the drawing) for the full width of the paper web, W, is provided with end sealing means as at locations along or outboard the sides of the paper web, W (as is generally well known in the art), is defined generally by the throttle plate or member 2, the paper web, W, which is held against the cooperating rotating drum 3, and the rolling doctor rod 4, base or bed 8 and resiliently deflectable member 12. Preferably, a resiliently deflectable or elastomeric hose or conduit 10, carried as by body or housing means 13, is provided which can be internally selectively pressurized by a fluid medium so as to thereby apply the desired force as against the support bed 8 and rolling doctor rod 4 in a direction generally toward the paper web, W, and rotating cylinder 3. Similarly, a resiliently deflectable or elastomeric internally fluidly pressurizable hose or conduit may be provided for controllably applying a desired force against a doctor blade 7 (carried as by suitable support or frame means) to thereby attain the desired contact pressure, of doctor blade 7, against the moving paper web, W.

An additional resiliently deflectable or elastomeric internally fluidly pressurizable hose or conduit 14 may be operatively carried as by housing or body means 13 as to bear against and serve as retention means for the resiliently deflectable member 12.

Just as a selected gap 5 is established as between throttle member 2 and the cylinder-backed web, W, so too a second effective gap 6 is formed generally by the rolling doctor 4 and the web, W.

Briefly, in operation, a coating substance, under superatmospheric pressure, is delivered via conduit 15 to the chamber generally surrounding it from where such coating substance flows upwardly as to be discharged from the said slit-like discharge mouth into the applicator space or chamber 1 and generally toward the moving paper web, W. Purposely, such coating substance is delivered into applicator space 1 at a rate which is in excess of the rate of coating substance to be applied to the moving web, W, as determined by the rolling doctor rod 4. Such excess amount of coating substance flows outwardly, from applicator chamber 1, through transverse gap or opening 5 and downwardly therefrom as into a catch basin or the like as generally depicted in the lower right portion of FIG. 1.

The moving belt or web, W, with the relatively heavier application of the coating substance applied as at the area of doctor rod 4, continues to move and in so moving causes the doctor blade 7 to wipe off the amount of coating which is in excess of that desired to then be on the belt or web, W. Such final excess of coating material as is removed by the doctor blade 7 flows downwardly as into an associated catch basin or the like as generally depicted in the lower left portion of FIG. 1.

In practicing the invention, the excess quantity removed by the doctor blade 7 amounts to about five to twenty times the amount of final coating application remaining on the web material after the coating material has been wiped off by the doctor blade 7. It has been discovered that in order to be able to obtain such a large excess amount, the doctor rod 4 of the invention has grooves which if formed by a rolling doctor rod wrapped with cross-sectionally round wire would require a wire diameter of from 1.5 mm to 4.0 mm. Since it is extremely difficult to wrap rolling doctor rods with wires of such diameters, the invention also provides a rolling doctor rod with a groove or grooves formed therein as by a roll-forming process.

Rolling doctor rods with round wire wrapping are known as from U.S. Pat. No. 2,970,564 and the publication "Wochenblatt Der Papierfabrikation", No. 16, dated 1973, (at pages 164 to 168 thereof) and are used only for the final smoothing of the coating application or only for those purposes where a very small, if any, excess of coating material is employed. Further, the inventor named in said U.S. Pat. No. 2,970,564 has, according to U.S. Pat. No. 3,084,663, proposed that the height or depth of the grooves on or in the rolling doctor rod should be in the range of 0.08 mm. and 0.10 mm. In view of this it can be seen that such prior art is concerned only with a very small, if any, excess amount of coating material to be applied or determined by a rolling doctor rod.

In contrast, apparatus employing teachings of the invention is effective for producing final coating weights between 10 to at least 15 g/m$^2$ at web speeds greater than 800 m/min. In such situations the excess quantity effectively wiped off by the doctor member 7 would be approximately 100 to 50 g/m$^2$ and perhaps between 50 to 80 g/m$^2$ at very high web speeds of more than 1200 m/min., where the penetration time is not so long.

In practicing the invention, the rolling doctor rod 4, rotatably driven as usual, is preferably loaded along its bed 8 by means of the pressurizable hose 10 pressurized to about 0.5 to 1.5 bar. It is also preferred that the applicator chamber 1 and the coating material therein also be under a pressure of between 0.1 to 0.5 bar.

Figure 2:
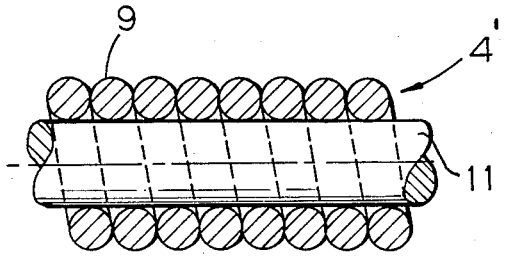
FIG. 2 illustrates a roller doctor rod formed as by wire helically wound about a central rod with the wire being shown in transverse cross-section.

FIG. 2 illustrates a rolling doctor rod 4', employing teachings of the invention, wherein a wire 9 of a diameter, d, in the range of 1.5 mm to 4.0 mm, is tightly coiled in an abutting coil relationship on and about a solid rod 8. The wire 9 thusly tightly coiled forms circumferential grooves defined as by the outer contour of the wire 9 and extending from the radially outer most portion of the wire to where the coils of wire are effectively in abutting relationship.

Figure 3:
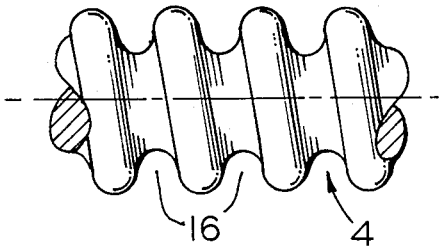
FIG. 3 illustrates, in elevation, a fragmentary length of a rolling doctor member employing teachings of the invention.

FIG. 3 illustrates a rolling doctor 4 also employing teachings of the invention. The rolling doctor 4 is illustrated as preferably comprised of a solid rod-like member with circumferential grooves 16 formed therein about the axis thereof. The circumferential grooves 16, depicted as being in a screw thread configuration, are produced as by a rolling or pressing manufacturing operation and not by the use of wrapped wire as depicted in FIG. 2, and, importantly, not as by a machine-tool metal cutting operation.

Figure 5:
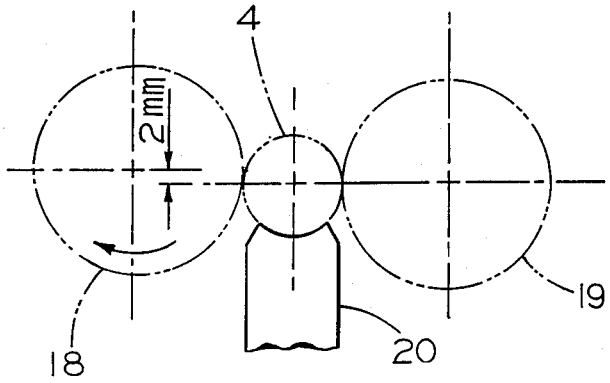
FIG. 5 is a view illustrating, generally schematically, apparatus for producing a rolling doctor rod with rolled grooves.

FIG. 5 depicts an arrangement for producing a rolling doctor employing teachings of the invention. In FIG. 5, the workpiece is the rolling doctor 4 (to be or being formed) situated generally between two threaded rolling cylinders 18 and 19 which, at their circumferences carry a thread form complementary to that to be formed on the rolling doctor rod 4. The cylinders 18 and 19 are rotatable as in the direction of the indicated arrows and one of them, as cylinder 19, is further displaceable in the direction of the workpiece 4 and can be pressed thereagainst as by hydraulic pressure rams. Preferably, one of the rollers as 18 has its axis raised (as viewed in FIG. 5) approximately 2.0 mm above the plane containing the axes of workpiece 4 and forming roller 19 thereby assuring a relative downward force against workpiece 4 preventing its upward movement during the forming of the threads therein. Downward movement of the workpiece 4 is prevented by suitable support means 20.

Figure 4:
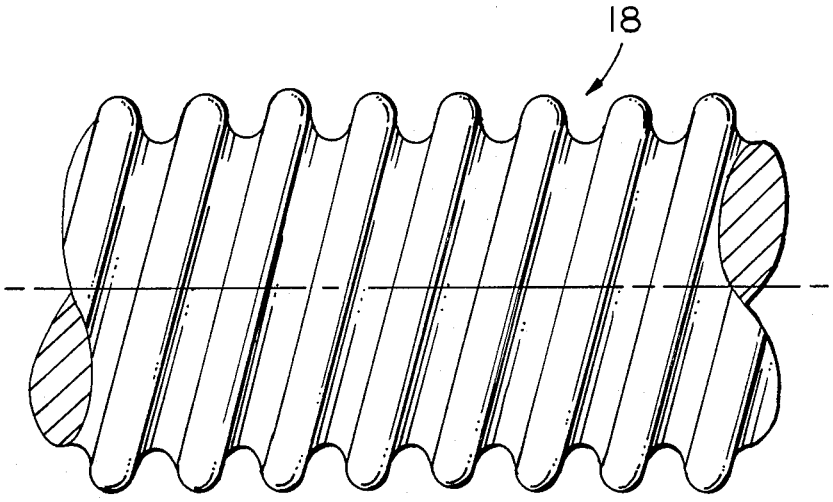
FIG. 4 illustrates, in elevation, a fragmentary length of a rolling cylinder, employable as a tool in forming a rolling doctor employing teachings of the invention.

The preferred configuration for the forming rollers 18 and 19 is that as depicted, by way of example, by fragmentarily illustrated roller 18 in FIG. 4. If, as herein disclosed, such forming rollers 18 and 19 each have a diameter twice that of the rolling doctor 4 to be formed, a dual spiral thread must be provided at their generated surfaces. In accordance with the multiple factor of the diameter of the threaded cylinders relative to the diameter of the rolling doctor rod, the number of thread spirals of the rolling cylinders must be provided. In case the threaded part of the rolling cylinders is shorter than the total length of the threaded part of the doctor rod 4, the thread of the doctor rod 4 must be formed section by section by an axial displacement of the doctor rod 4 in accordance with the multiple factor of its length relative to the thread length of the rolling cylinders 18 and 19. While this requires exact axial positioning of the doctor rod 4 relative to the rolling cylinders, this is perfectly feasible with today's modern measuring and setting devices.

Although only a preferred embodiment of the invention has been disclosed and described it is apparent that other embodiments and modifications of the invention are possible within the scope of the appended claims.

What is claimed is:

1. A pre-dosing device for use in a coating arrangement for coating a moving web of penetrable or soakable material with coating material and having an applicator chamber for said coating material disposed at a rotating cylinder guiding the web of material to be coated by said coating material, wherein said applicator chamber comprises an inlet side and an outlet side with an inlet-side gap formed at said inlet side and an outlet-side gap formed at said outlet side, wherein said web of material passes through said inlet-side gap and said outlet-side gap, and wherein a doctor element is situated as to operatively engage said moving web of material at a location which is after said web of material exits and outlet side of said applicator chamber, said pre-dosing device comprising a rolling doctor having a longitudinally extending axis, wherein said rolling doctor comprises a longitudinally extending rotatable bar with wire closely wound around and carried by the rotatable bar, wherein circumferential grooves are defined by and between adjacent coils of said wound wire, wherein the space defined by said grooves at least in part forms said outlet-side gap, wherein the diameter of said wire is at least 1.5 mm, wherein said rolling doctor is effective for applying a quantity rate of said coating material to said moving web of material as said moving web of material passes through said outlet-side gap and continues in its movement toward said doctor element, wherein said quantity rate of coating material once applied to said moving web of material remains constant and unaltered until acted upon by said doctor element, wherein said doctor element in acting upon said quantity rate of coating material is effective for removing an amount of said coating material from said web of material, and wherein said amount of said coating material removed by said doctor element is in the range of from five to twenty times the amount of said coating material remaining on said web of material.

2. A pre-dosing device according to claim 1 wherein said circumferential grooves helically extend along said rolling doctor.

3. A pre-dosing device according to claim 1 and further comprising bed means for supporting said rolling doctor, and wherein said bed means and rolling doctor are urged toward said moving web of material by pressurizable means having an internal pressure in the order of 0.5 to 1.5 bar.

4. A pre-dosing device according to claim 1 wherein said coating material within said applicator chamber is under a pressure of between 0.1 to 0.5 bar.

5. A pre-dosing device according to claim 1 wherein said doctor bar comprises an axially extending cylindrical surface, and wherein the diameter of said cylindrical surface is at least 5.0 mm.

6. A pre-dosing device according to claim 1 wherein said doctor bar comprises an axially extending cylindrical surface, and wherein the diameter of said cylindrical surface is at least 7.0 mm.

7. A pre-dosing device according to claim 1 wherein the diameter of said wire is between 1.6 mm and 4.0 mm.

8. A pre-dosing device for use in a coating arrangement for coating a moving web of penetrable or soakable material with coating material and having an applicator chamber for said coating material disposed at a rotating cylinder guiding the web of material to be coated by said coating material, wherein said applicator chamber comprises an inlet side and an outlet side with an inlet-side gap formed at said inlet side and an outlet-side gap formed at said outlet side, wherein said web of material passes through said inlet-side gap and said outlet-side gap, and wherein a doctor element is situated as to operatively engage said moving web of material at a location which is after said web of material exits said outlet side of said applicator chamber, said pre-dosing device comprising a rolling doctor having a longitudinally extending axis, wherein said rolling doctor comprises a longitudinally extending rotatable bar with circumferential grooves formed therein and about said axis, wherein the space defined by said grooves at least in part forms said outlet-side gap, wherein the cross-sectional areas of said grooves is at least 0.225 sq. mm, wherein said rolling doctor is effective for applying a quantity rate of said coating material to said moving web of material as said moving web of material passes through said outlet-side gap and continues in its movement toward said doctor element, wherein said quantity rate of coating material once applied to said moving web of material remains constant and unaltered until acted upon by said doctor element, wherein said doctor element in acting upon said quantity rate of coating material is effective for removing an amount of said coating material from said web of material, and wherein said amount of said coating material removed by said doctor element is in the range of from five to twenty times the amount of said coating material remaining on said web of material.

9. A pre-dosing device according to claim 8 wherein said grooves are formed by a rolling manufacturing operation.

10. A pre-dosing device according to claim 8 wherein said grooves helically extend along said longitudinally extending rotatable bar.

11. A pre-dosing device according to claim 8 and further comprising bed means for supporting said rolling doctor, and wherein said bed means and said rolling doctor are urged toward said moving web of material by pressurizable means having an internal pressure in the order of 0.5 to 1.5 bar.

12. A pre-dosing device according to claim 8 wherein said coating material within said applicator chamber is under a pressure of between 0.1 to 0.5 bar.

13. A pre-dosing device according to claim 8 wherein the diameter of the core of the rotatable bar is at least 5.0 mm.

14. A pre-dosing device according to claim 8 wherein the diameter of the core of the rotatable bar is at least 7.0 mm.

15. A pre-dosing device according to claim 8 wherein the cross-sectional areas of said grooves is not larger than 1.60 sq. mm.

16. A process for applying a coating substance to a moving web of penetrable or soakable material by chamber means receiving said coating substance and an applicator space having an inlet side and an outlet side, said coating substance being received by conduit means from said chamber means in order to discharge said coating substance into said applicator space at a superatmospheric pressure, wherein said applicator space comprises an inlet-side gap formed at said inlet side and an outlet-side gap formed at said outlet side, wherein said moving web of material first passes through said inlet-side gap ant then exits through said outlet-side gap, wherein a doctor element is positioned as to operatively engage said moving web of material at a location which is after said moving web of material exits said outlet side of said applicator space, forming a rolling doctor from a longitudinally extending rotatable bar with wire closely wound thereabout and carried by said rotatable bar as to thereby define circumferential grooves by and between adjacent coils of said wound wire, employing said rolling doctor for pre-dosing said moving web of material with said coating substance by positioning said rolling doctor in a manner so that the space defined by said grooves at least in part forms said outlet-side gap, applying said coating substance to said moving web of material and employing said rolling doctor and the circumferential grooves thereof to meter the quantity rate of said coating substance applied to said moving web of material, wherein the step of employing said rolling doctor and the circumferential grooves thereof to meter the quantity rate of said coating substance comprises the step of applying a metered quantity rate of said coating substance far in excess of the actual quantity rate of coating substance desired to be carried by said moving web of material, having said metered quantity rate of said coating substance remain constant and unaltered as said moving web of material passes from said outlet-side gap and moves away therefrom and towards said doctor element, and having said doctor element act upon said metered quantity rate of said coating substance as to remove an amount of said coating substance from said moving web of material, and wherein the step of removing an amount of said coating substance from said moving web of material comprises the step of removing an amount thereof which is in the range of from five to twenty times the amount of said coating substance remaining on said moving web of material with said coating substance remaining on said moving web of material being said actual quantity rate of coating substance desired to be carried by said moving web of material.

17. A process for applying a coating substance to a moving web of penetrable or soakable material by chambar means receiving said coating substance and an applicator space having an inlet side and an outlet side, said coating substance being received by conduit means from said chamber means in order to discharge said coating substance into said applicator space and maintain said coating substance within said applicator space at a superatmospheric pressure, wherein said applicator space comprises an inlet-side gap formed at said inlet side and an outlet-side gap formed at said outlet side, wherein said moving web of material first passes through said inlet-side gap and then exits through said outlet-side gap, wherein a doctor element is positioned as to operatively engage said moving web of material at a location which is after said moving web of material exits said outlet side of said applicator space, forming a rolling doctor from an axially longitudinally extending rotatable bar with circumferential grooves formed therein and about said axis, employing said rolling doctor for pre-dosing said moving web of material with said coating substance by positioning said rolling doctor in a manner so that the space defined by said grooves at least in part forms said outlet-side gap, applying said coating substance to said moving web of material and employing said rolling doctor and the circumferential grooves thereof to meter the quantity rate of said coating substance applied to said moving web of material, wherein the step of employing said rolling doctor and the circumferential grooves thereof to meter the quantity rate of said coating substance comprises the step of applying a metered quantity rate of said coating substance far in excess of the actual quantity rate of coating substance desired to be carried by said moving web of material, having said metered quantity rate of said coating substance remain constant and unaltered as said moving web of material passes from said outlet-side gap and moves away therefrom and towards said doctor element, and having said doctor element act upon said metered quantity rate of said coating substance as to remove an amount of said coating substance from said moving web of material, and wherein the step of removing an amount of said coating substance from said moving web of material comprises the step of removing an amount thereof which is in the range of from five to twenty times the amount of said coating substance remaining on said moving web of material with said coating substance remaining oon said moving web of material being said actual quantity rate of coating substance desired to be carried by said moving web of material.

* * * * *